United States Patent [19]

Detzer et al.

[11] Patent Number: 4,790,080

[45] Date of Patent: Dec. 13, 1988

[54] APPARATUS FOR CLEANING CONTAMINATED SURFACES BY MEANS OF FLOWING AIR

[75] Inventors: Rudiger Detzer, Alten-Buseck; Dietfried Gersch, Giessen, both of Fed. Rep. of Germany

[73] Assignee: Kessler & Luch GmbH, Giessen, Fed. Rep. of Germany

[21] Appl. No.: 14,265

[22] Filed: Feb. 12, 1987

[30] Foreign Application Priority Data

Feb. 13, 1986 [DE] Fed. Rep. of Germany ..... 3604422

[51] Int. Cl.[4] ..... F24F 9/00

[52] U.S. Cl. ..... 34/225; 98/36

[58] Field of Search ..... 98/36, 1, 31.5; 34/225, 34/233; 15/301

[56] References Cited

U.S. PATENT DOCUMENTS 3,190,207 6/1965 Weisz ..... 98/36
3,285,693 11/1966 Madl, Jr. ..... 15/301
3,308,740 3/1967 Henson et al. ..... 98/36

FOREIGN PATENT DOCUMENTS 3403547 8/1985 Fed. Rep. of Germany ..... 98/36

*Primary Examiner*—Larry I. Schwartz
*Attorney, Agent, or Firm*—Herbert L. Lerner; Laurence A. Greenberg

[57] ABSTRACT

A pass-through station for conducting an air flow and for cleaning contaminated surfaces in the station with flowing air and preventing dust particles removed during the decontamination from undesirably reaching the room to be kept clean which is supplied through the pass-through station, includes a passageway for conducting an air flow having a substantially circular air flow cross section, a central axis, oppositely disposed segmental side walls and end surfaces, air chambers alongside the passasgeway having segmental inner walls forming the oppositely disposed segmental side walls, the inner walls of the air chambers having at least one pair of slit-like air outlets formed therein diametrically opposite one another with respect to the central axis, and at least one return air pipe coaxial to the substantially circular cross section at least at one of the end surfaces, for removing an air component corresponding to the inflowing air.

15 Claims, 2 Drawing Sheets

APPARATUS FOR CLEANING CONTAMINATED SURFACES BY MEANS OF FLOWING AIR

The invention relates to clean-room technology and specifically to an apparatus for cleaning contaminated surfaces in a pass-through station through which air flows, by using flowing air.

Manufacturing, testing, therapy and nursing in certain fields demand especially careful precautions in order to prevent contamination from being brought into laboratories or patient rooms on the surface of articles, including the protective clothing of the staff. Such precautions are carried out in clean rooms, in which the standards of cleanliness are subject to different requirements depending on the work to be done. Often, such clean rooms are flooded with a vertical or horizontal low-turbulence combustion flow, while other flow conditions can exist in other fields. It is generally a characteristic of clean rooms that they have an overpressure as compared with their surroundings, in order to prevent airborne importation of contamination. The problem therefore arises of how to construct the entrances and pass-throughs for clean rooms such that a change of air can only occur in the direction of the pressure drop, if at all and that the surface of the articles to be brought in, or the staff entering the room, is cleaned in the entry area. For this purpose, antechambers are known in which the surface is blown off from a multiplicity of jet nozzles, so that contaminant particles adhering to the surface and hence contamination will be removed. However, because of induction, the great number of such jets has the effect of spreading contaminants, because it is unavoidable in such jet equipment that ambient air will be aspirated by each jet and accelerated by a transfer of pulses. The aspirated air then contains many of the particles that have just been loosened and removed and the particles therefore enter into the clean-air portion of the jet core. This transfer of particles is promoted by the small dimensions of the antechambers, which should not be larger than the goods to be brought in nor larger than is necessary for a person to walk through, if they are to be operated economically; although reducing the dimensions augments the jet action, the substantially active core region of the jet nevertheless has an effective length when dealing with round jets, of only about 6 to 8 times the diameter of the orifice of the jet nozzle.

It is accordingly an object of the invention to provide an apparatus for cleaning contaminated surfaces by means of flowing air, which overcomes the hereinaforementioned disadvantages of the heretofore-known devices of this general type and to further develop such antechambers in such a way that they can be more safely operated so as to effectively prevent a change of air when the pressure drop is reversed, that a flow capable of decontaminating surfaces prevails in these antechambers and that the air which is laden with particles after striking the surface flows out in an intended, controllable manner.

With the foregoing and other objects in view there is provided, in accordance with the invention, a pass-through station for conducting an air flow and for cleaning contaminated surfaces in the station with flowing air, comprising a passageway forming the actual pass-through station for conducting an air flow having a substantially circular air flow cross section, a central axis, oppositely disposed segmental side walls and end surfaces, air chambers alongside or on both sides of the passageway having segmental inner walls forming the oppositely disposed segmental side walls, the inner walls of the air chambers having at least one pair of slit-like air outlets formed therein diametrically opposite one another with respect to the central axis, and at least one return air pipe coaxial to the substantially circular cross section at least at one of the end surfaces.

The result of this construction is an antechamber that has means for placing the air contained therein into a rotational flow, the tangential velocity of the air having a radial velocity component superimposed thereon, because return air is removed from the rotational flow coaxially with the rotational axis, and this return air is replaced from both the air of the clean room and the air of the antechamber, depending on the pressure conditions. The outflow is along spiral paths and thus can be controlled. The air velocity is so high, especially in the outer regions of the flow, that contaminants can be removed by entrainment. This occurs upon both entering and leaving the pass-through chamber. As a result of the removal of the contaminated air toward one or both end surfaces, an increase in the particulate content of the air in the pass-through station is avoided.

In accordance with another feature of the invention, the at least one pair of slit-like air outlets is in the form of a plurality of pairs of slit-like outlets distributed over the segmental side walls in accordance with their number, the pairs of slit-like outlets being axially symmetrically and diametrically opposite one another with respect to the central axis. As a result of this embodiment, the pulse for driving the air roller is introduced through a plurality of pairs of slit outlets, one slit outlet of a pair being provided in the side wall of one air chamber and the other slit of the pair being provided in the opposite side wall of the other air chamber. When two pairs are used, it is recommended that one slit outlet be provided at the beginning of the flow-guiding segmental wall and the other at the end of this wall. Naturally, additional slit outlets may also be provided along the course of the wall, to impart pulses and in particular to compensate for flow losses due to friction along the segmental walls.

In accordance with a further feature of the invention, the passageway has a given effective diameter, the slit-like air outlets have a width in a ratio of substantially between 1:20 and 1:60 relative to the given effective diameter, and including means for blowing cleaning air at a velocity substantially between 10 m/s and 30 m/s. These conditions at the slit-like air outlets, which extend over the entire height and may also have interruptions, ensure the fact that a stable impact flow is induced by the jet pulse, at an air velocity that is favorable for cleaning of the surfaces.

In accordance with an added feature of the invention, there are provided means for pivoting the slit-like outlets for adjusting jet orientations thereof from substantially tangential to substantially radial relative to the substantially circular cross section.

In accordance with an additional feature of the invention, there are provided additional jet nozzles in addition to the pairs of slit-like outlets, the additional jet nozzles having jet axes and means for orienting the jet axes at most tangentially to the substantially circular cross section and for pivoting the jet axes toward the center of the substantially circular cross section. The pivotable slit outlets enable the pulse to be imparted to the rotational flow in a manner adapted to prevailing conditions. It is unnecessary for the slit outlets themselves to be physically pivoted, as long as the orientation of the jet is steered as conditions require by means of guide elements or guide surfaces built into the slit outlets. The additional jet nozzles are substantially necessary whenever the configuration of the surfaces to be decontaminated in the cleaning station requires it. This is the case particularly if undercuts or cavities, which create a turbulent region in the rotational flow, are to be taken into account.

In accordance with yet another feature of the invention, there is provided a flow director disposed in the air chambers upstream of the slit-like outlets and the optional additional jet nozzles, as seen in air flow direction.

In accordance with yet a further feature of the invention, the flow director is in the form of a flow guidance surface disposed obliquely with respect to the inner walls for restricting the air flow cross section.

In accordance with yet an added feature of the invention, there is provided a flow director in the form of a filter wall with a given height disposed upstream of the flow chambers as seen in air flow direction, the filter wall having air filters distributed entirely over the given height. In order to generate a rotational flow that is uniform over the entire height, especially in very high pass-through stations, the velocity of the air blown out of the slit-like air outlets must be substantially uniformly distributed over the entire height. With narrow air chambers, particular provisions must be made for equalizing the velocity of the blown air. One possibility is for the air chamber cross section, that can be thought of as a flow conduit, to be restricted with an obliquely built-in flow guidance surface in such a way that its flow cross section decreases continuously with its distance from the air inlet. Another proposal is for the incorporation of an additional flow-aligning resistance, in the form of air filters. These air filters are inserted into a filter wall defining the air chamber and they are distributed substantially uniformly over the entire height. When the dimensions of the circular cross section of the cleaning station are considerable, two perpendicular rows of air filters are suitably used.

In accordance with yet an additional feature of the invention, there is provided a blower having an outlet and an inlet, pressure lines connected from the outlet of the blower to the incoming air chambers, and intake lines connected from the air fittings of the air chambers to the inlet fitting of the blower.

In accordance with still another feature of the invention, there is provided a filter unit connected to the pressure lines for incoming air.

In accordance with still a further feature of the invention, there is provided a filter unit connected to the intake lines for return air.

In accordance with still an added feature of the invention, there is provided a blow-out valve connected to the pressure lines for limiting overpressure of the incoming air.

In these embodiments, the apparatus is operated with air circulated in a loop, so that it is independent of the ventilation system of the clean room and antechamber. The disposition of filter units in the pressure line for the incoming air and/or in the intake line for the return air makes it possible to filter out the particulate contaminants removed from contaminated surfaces in the pass-through station. Naturally, it is also possible to use adsorption filters, for example, to filter out contaminants in gaseous or vapor form. Since the volumetric flow of the return air may be greater than that of the incoming air, because of the transfer of air from the clean room or antechamber into the rotational flow, it is suitable to provide an overpressure-limiting blow-out valve, if the blower is to be operated in a stationary state. Due to this blow-out valve, the admission pressure for the slit-like air outlets in the side walls of the pass-through station can be kept constant at the same time, without entailing additional expenditure for controls.

In accordance with a concomitant feature of the invention, the air chambers have at least one return air fitting, and including counterrotational elements disposed in the at least one return air fitting for converting rotational energy into aimed flow energy. With this provision, the existing rotational pulse in the return air resulting from the introduction of pulses into the rotational flow is converted into a forwardly oriented flow pulse, thus lessening the pressure difference that has to be brought to bear by the blower. As a result, the power the blower must bring to bear, and hence its power loss from conversion to heat, are lessened as well.

With these proposals, a cleaning station is disclosed in which even articles having complicated shapes can be effectively cleaned. It is understood that the cleaning station can also be used as a cleaning station for the staff working in the clean room, where the substantial disadvantages over the "air showers" used thus far, having highly turbulent jets of air pointing at one another, are avoided. This also avoids an undesirable transfer of particles from "blow-through", a phenomenon that occurs when the air jets of these air showers point at one another and which is unavoidable when articles are passed through or when people walk through the station. This danger does not exist for the contaminants removed by the additional blower jets of the invention, because these contaminants are caught in the rotational flow and cannot be brought into the clean room along with an air jet interrupting the rotational flow. Since the pivoting angle of the additional jet nozzles is limited between a tangential direction and a radial direction, these additional jet nozzles provide the flow with an additional pulse, which reinforces the rotational flow; obviously these additional jets are not positioned against the rotational flow.

For effective surface cleaning in the area of the pass-through station, it is useful for the ratio between its diameter and the diameter of the return air tube or tubes to be in the range from 2:1 to 4:1. This ratio substantially defines the dwell time of the contaminated air in the vicinity of the rotational flow and also sets limits for values that are favorable in practical conditions.

Other features which are considered as characteristic for the invention are set forth in the appended claims.

Although the invention is illustrated and described herein as embodied in an apparatus for cleaning contaminated surfaces by means of flowing air, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
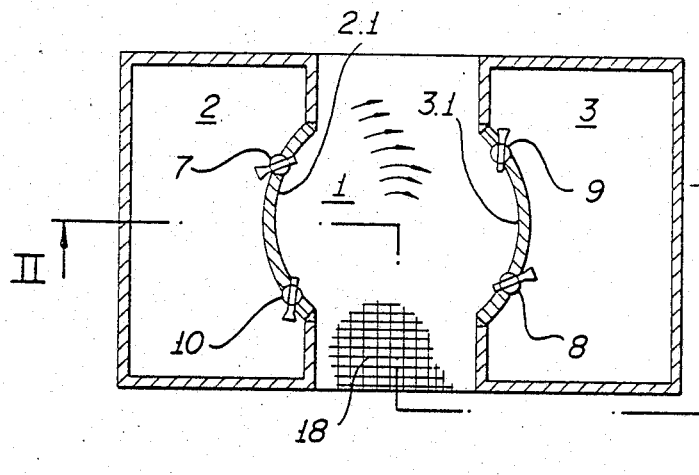
FIG. 1 is a horizontal-sectional view of a pass-through station having air chambers, taken along the line I—I in FIG. 2, in the direction of the arrows.

Referring now to the figures of the drawings in detail and first, particularly, to FIG. 1 thereof, it is seen that the pass-through station is formed of two air chambers 2 and 3, between which a passageway in the form of an actual cleaning zone 1 is located. Inner walls 2.1 and 3.1 of the air chambers 2 and 3 are in circular-segmental form, so that segments thereof substantially define a substantially circular cross section. Pairs of slit-like air outlets 7 and 8 as well as 9 and 10, which are pivotable between tangential and radial positions, are provided diametrically opposite one another in the inner walls 2.1 and 3.1 of the two air chambers 2 and 3. It will be understood that all of these air outlets are aligned in the same direction, so that the final result is a flow distribution in the region of the cleaning zone 1 of the pass-through station schematically shown in the drawing.

Figure 2:
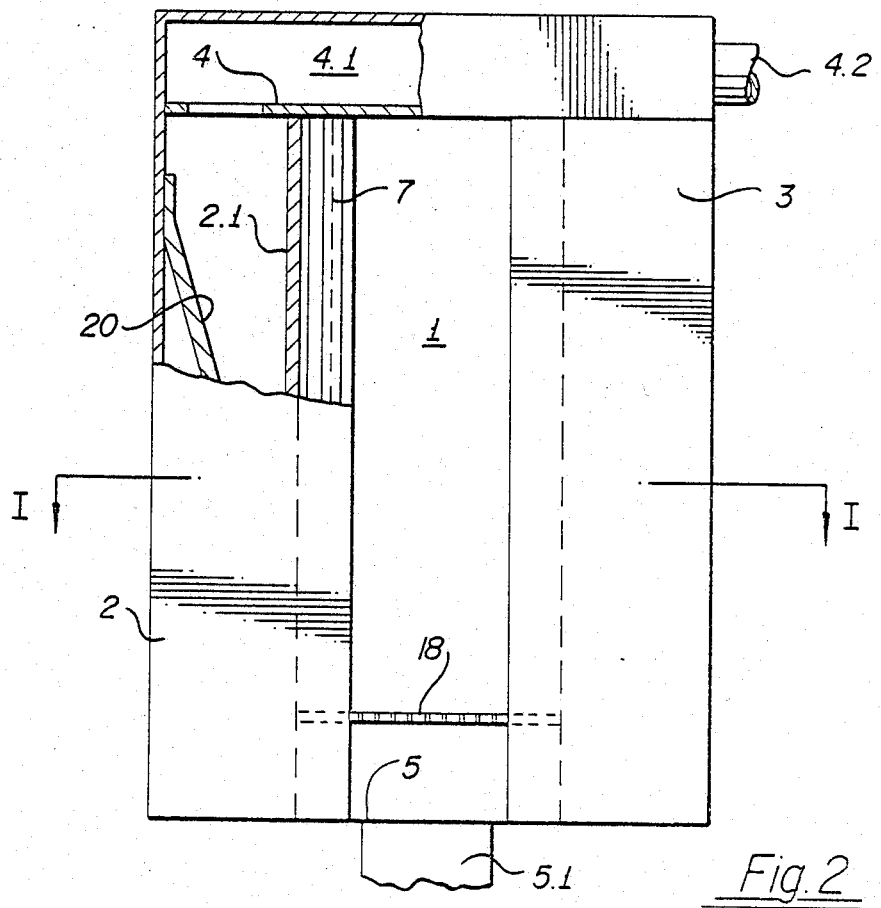
FIG. 2 is a side-elevational view of the pass-through station and air chambers taken along the line II—II in FIG. 1, in the direction of the arrows, in which one air chamber is partially broken away and in section.

An essential factor in the formation of this potential flow is a pulse inflow through the air outlets and an outflow through a return air outlet 5.1 seen in FIG. 2 but not in FIG. 1. The pass-through station is provided with an air-permeable bottom or floor 18, which receives articles to be passed through having surfaces to be decontaminated, or which serves as a grating for people to walk on as they move through the station.

FIG. 2 is a side or front view of the pass-through station which is ready for attachment, with the two air chambers 2, 3 on both sides of the passageway 1 and the air chamber 2 partly broken away and sectioned along the line II—II of FIG. 1. A ceiling 4 of the pass-through station supports a lined incoming air chamber 4.1 into which incoming air flows through a fresh-air connecting pipeline 4.2. The incoming air reaches the interior of the air chamber 2 through an overflow opening at the left side of the air chamber 4.1 in FIG. 2, flows through the slit-like outlets 7 and 10 seen in FIG. 1 in an approximately tangential direction and flows into the flow region of the passageway 1 of the pass-through station. The air chamber 3 disposed on the opposite side is identically constructed, so that a rotationally symmetrical inflow of the incoming air always takes place, regardless of the number of pairs of slit-like outlets. As may be seen from the partially broken away and sectioned portion of the air chamber 2, obliquely disposed flow guidance surfaces 20 which restrict the cross section of the air chamber from the overflow opening in the ceiling plate 4 toward a floor plate 5 are inserted into the air chamber, in order to assure the blow-out velocity over the entire height of the flow region of the passageway 1 of the pass-through station. The lower connection is formed of the floor plate 5, in which the air pipe 5.1 is centrally disposed, concentric with the base circle defined by the circular sectors. The air-permeable floor 18, which is spaced at a distance above the floor plate 5 and which is advantageously a grating, makes it possible to set articles down or to walk through the passageway 1 of the pass-through station.

Figure 3:
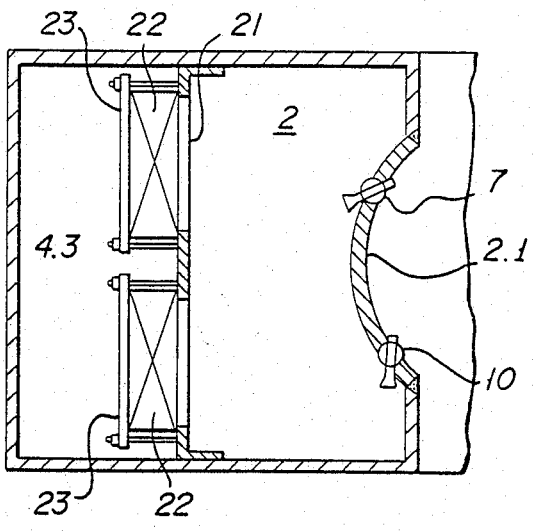
FIG. 3 is a fragmentary horizontal-sectional view similar to FIG. 1, showing an air chamber having a filter wall.

FIG. 3 is a sectional view of an air chamber, using the air chamber 2 as an example. Once again it is understood that since symmetry is to be maintained the air chamber 3 has an equivalent structure. The rear closure of the air chamber 2 is formed of a filter wall 21, which is secured to the side walls of the air chamber 2 in an air-tight manner. Suitable overflow openings are provided in the filter wall 21 for air filter cells 22, the cross section of the overflow openings being smaller than the filter cells 22 by at least the thickness of sealing rims of the filter cells. The filter cells 22 are located in an antechamber 4.3 leading to the incoming air chamber 4.1 and are pressed against the wall by clamping devices 23.

Figure 4:
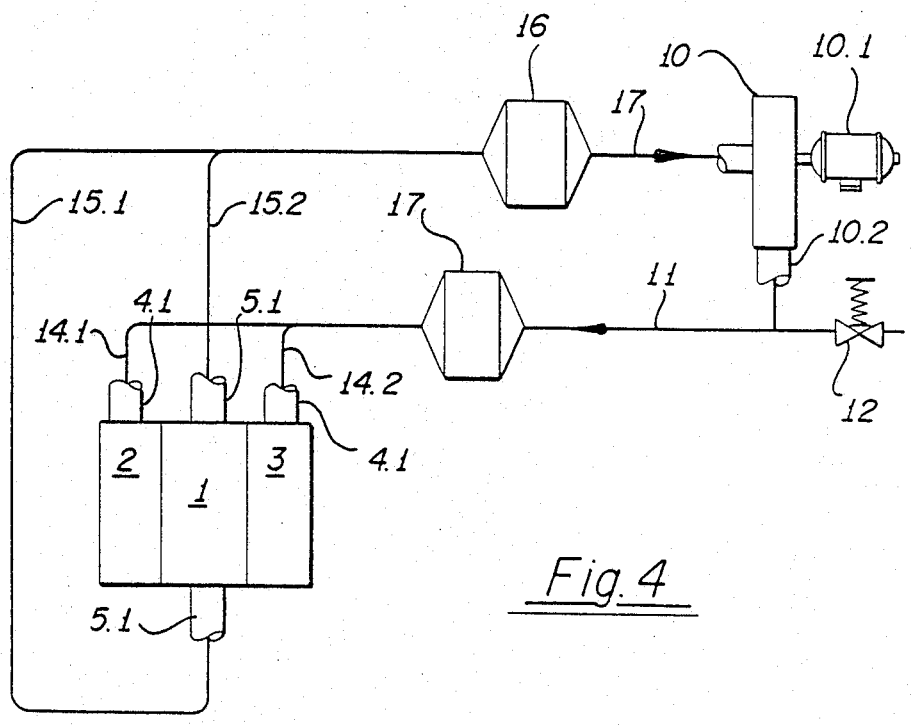
FIG. 4 is a schematic circuit diagram of the layout of the pass-through station.

Finally, FIG. 4 is a circuit diagram showing how air is supplied to the air chambers 2 and 3 and how used air is removed from the passageway 1 of the pass-through station. The air for the entire system is moved by a blower 10, which is driven by a drive motor 10.1. The incoming air leaves the blower through a connection fitting 10.2 and flows into an incoming air line 11. In order to limit the pressure level in the incoming air line 11, a blow-out fitting is provided with a blow-out or pressure-dependent valve 12, which may be any arbitrary overpressure valve, especially a spring-loaded or weighted valve. The incoming air is guided through an incoming air filter unit 17; naturally, this filter unit may be omitted if the air chambers 2 and 3 are preceded by flow directors having filters. The air chambers 2 and 3, which are supplied separately in FIG. 4, are supplied with incoming air through feeder lines 14.1 and 14.2 and incoming air chambers or fittings 4.1; the incoming air then flows through the paired slit-like air outlets 7 and 8 as well as 9 and 10 shown in FIG. 1, into the flow region of the passageway 1 of the pass-through station. In the embodiment of FIG. 4, the rotational flow that is established is centrally sucked away on both sides through the return or used air outlet or fitting 5.1 and is delivered through lines 15.1 and 15.2 to a return air filter unit 16. The return air filter unit 16 is useful especially if the contaminants that are to be removed are dangerous, for instance if they are radioactive or infectious. In conventional applications, the filter unit 16 can be dispensed with. Finally, the line 17 carries the used air back to the blower 10. Since the volumetric flow of air circulating in the rotational flow cannot be prevented from filling up through the open sides of the passageway 1 of the pass-through station shown in FIG. 1, the blower 10 must be constructed with this induction in mind. The excess is then removed by the blow-out valve 12; the static overpressure is suitably generated at a flow resistance that is dependent on the volumetric flow.

The foregoing is a description corresponding in substance to German Application No. P 36 04 422.9, dated Feb. 13, 1986, the International priority of which is being claimed for the instant application, and which is hereby made part of this application. Any material discrepancies between the foregoing specification and the aforementioned corresponding German application are to be resolved in favor of the latter.

We claim:

1. Pass-through station for conducting an air flow and for cleaning contaminated surfaces in the station with flowing air, comprising a passageway for conducting an air flow having a substantially circular air flow cross section, a central axis, oppositely disposed segmental side walls and oppositely disposed end surfaces defining a given height of said passageway therebetween, air chambers alongside said passageway having segmental inner walls forming said oppositely disposed segmental side walls, said inner walls of said air chambers having at least one pair of slit-like air outlets formed therein diametrically opposite one another with respect to said central axis and extending over substantially all of said given height, and incoming air chamber connected in common to said air chambers, means disposed in said air chambers for evening out air outflow velocities from said air outlets over substantially all of said given height, and at least one return air pipe coaxial to said substantially circular cross section at least at one of said end surfaces.

2. Pass-through station according to claim 1, wherein said at least one pair of slit-like air outlets is in the form of a plurality of pairs of slit-like outlets distributed over said segmental side walls in accordance with their number, said pairs of slit-like outlets being axially symmetrically and diametrically opposite one another with respect to said central axis.

3. Pass-through station according to claim 1, wherein said passageway has a given effective diameter, said slit-like air outlets have a width in a ratio of substantially between 1:20 and 1:60 relative to said given effective diameter, and including means for blowing cleaning air at a velocity substantially between 10 m/s and 30 m/s.

4. Pass-through station according to claim 1, including means for pivoting said slit-like outlets for adjusting jet orientations thereof from substantially tangential to substantially radial relative to said substantially circular cross section.

5. Pass-through station according to claim 1, including additional jet nozzles in addition to said pairs of slit-like outlets, said additional jet nozzles having jet axes and means for orienting said jet axes at most tangentially to said substantially circular cross section and for pivoting said jet axes toward the center of said substantially circular cross section.

6. Pass-through station according to claim 1, wherein said air outflow evening out means are in the form of a flow director disposed in said air chambers upstream of said slit-like outlets, as seen in air flow direction.

7. Pass-through station according to claim 5, wherein said air outflow evening out means are in the form of a flow director disposed in said air chambers upstream of said slit-like outlets and said additional jet nozzles, as seen in air flow direction.

8. Pass-through station according to claim 6, wherein said flow director is in the form of a flow guidance surface disposed obliquely with respect to said inner walls for restricting said air flow cross section.

9. Pass-through station according to claim 1, including a flow director in the form of a filter wall with a given height disposed upstream of said flow chambers as seen in air flow direction, said filter wall having air filters distributed entirely over said given height.

10. Pass-through station according to claim 1, including a blower having an outlet and an inlet, pressure lines connected from said outlet of said blower to said air chambers, and intake lines connected from said air chambers to said inlet of said blower.

11. Pass-through station according to claim 10, including a filter unit connected to said pressure lines for incoming air.

12. Pass-through station according to claim 10, including a filter unit connected to said intake lines for return air.

13. Pass-through station according to claim 10, including a blow-out valve connected to said pressure lines for limiting overpressure of the incoming air.

14. Pass-through station according to claim 10, wherein said air chambers have at least one return air fitting, and including counterrotational elements disposed in said at least one return air fitting for converting rotational energy into aimed flow energy.

15. Pass-through station according to claim 1, wherein said air outflow evening out means are in the form of filters dividing said air chambers into an antechamber and an outlet chamber equalizing differential pressures at said filters over substantially all of said given height.

* * * * *